US005209093A

United States Patent [19]

Cadwell

[11] Patent Number: 5,209,093

[45] Date of Patent: May 11, 1993

[54] APPARATUS FOR SUPERPLASTIC FORMING OF LARGE CYLINDRICAL STRUCTURES

[75] Inventor: Gilbert C. Cadwell, Lakeside, Calif.

[73] Assignee: Rohr, Inc., Chula Vista, Calif.

[21] Appl. No.: 877,719

[22] Filed: May 4, 1992

[51] Int. Cl.[5] ..... B21D 26/02

[52] U.S. Cl. ..... 72/62; 72/60; 72/709; 72/342.94; 29/421.1

[58] Field of Search ..... 72/60, 61, 62, 342.94, 72/709; 29/421.1; 228/157

[56] References Cited

U.S. PATENT DOCUMENTS

| | | | |
|---|---|---|---|
| 4,429,824 | 2/1984 | Woodward | 228/157 |
| 4,437,326 | 3/1984 | Carlson | 72/62 |
| 4,765,166 | 8/1988 | Bergman et al. | 72/60 |
| 4,951,491 | 8/1990 | Lorenz | 29/421.1 |
| 4,984,732 | 1/1991 | Hudson et al. | 29/421.1 |

*Primary Examiner*—David Jones

*Attorney, Agent, or Firm*—Patrick J. Schlesinger; Frank Gilliam

[57] ABSTRACT

An SPF press is capable of forming large generally cylindrical structures from a sheet made of a first metal such as Titanium. The sheet is first rolled into a cylindrical or conical part blank. The press has a generally cylindrical ceramic die with a surface defining the contour of a part to be formed. The part is formed by pressing a first side of the part blank against the die utilizing high pressure gas. Generally cylindrical gas impervious seals overlie the opposite ends of the cylindrical part blank on a second side thereof opposite the first side. Each of these gas impervious seals includes a support member and a seal member which are spaced apart to define a gap therebetween. A generally cylindrical seal ring is seated in each gap and contacts the second side of the cylindrical part blank. The seal rings are made of a second metal that is softened at a temperature at which the first metal becomes superplastic. This allows the seal rings to deform and provide a substantially gas impervious seal to prevent high pressure gas introduced against a medial portion of the cylindrical part blank from escaping to the ends of the part blank.

16 Claims, 1 Drawing Sheet

APPARATUS FOR SUPERPLASTIC FORMING OF LARGE CYLINDRICAL STRUCTURES

BACKGROUND OF THE INVENTION

The present invention relates to apparatus for fabricating large generally cylindrical structures from one or more metal sheets, and more particularly, to an apparatus for superplastic forming of such structures having substantial deformations.

For many years it has been known that certain metals, such as Titanium, as well as certain alloys, exhibit superplasticity within limited temperature ranges and strain rates. Superplasticity is the capability of a material to develop unusually high tensile elongations with a reduced tendency towards necking. Thus when in a superplastic condition, the metal or metal alloy exhibits low resistance to deformation and may be elongated with controlled thinning. This permits a sheet of such metal to be rapidly formed against dies to achieve desired shapes. Superplastic forming (SPF) may be performed in conjunction with diffusion bonding (DB). Diffusion bonding refers to a metallurgical joining of surfaces of similar or dissimilar metals by holding them in physical contact and applying heat and pressure sufficient to cause commingling of the atoms at the junction. See for example U.S. Pat. Nos. 3,934,441 of Hamilton et al.; 3,927,817 of Hamilton et al.; 4,984,348 of Cadwell; and 5,016,805 of Cadwell.

In the aerospace industry, it is frequently necessary to form large generally cylindrical structures. As used herein, the term "generally cylindrical" refers to surfaces of revolution such as those obtained by rotating a line or curve about a central axis. These include cylinders, cones, frusto-conical structures and tubular configurations with undulating sidewalls. An example of such a structure is an exhaust mixer of a turbofan aircraft engine. Typically it comprises a plurality of axially extending, circumferentially spaced lobes which surround the core engine. The lobes mix the fan air and the hot exhaust gas from the turbine to obtain improved noise suppression and/or engine performance. Representative configurations of such exhaust mixers are disclosed in U.S. Pat. Nos. 4,077,206 of Ayyagari and 4,149,375 of Wynosky et al.

Large generally cylindrical structures utilized in connection with aircraft are frequently made of Titanium or other metal alloy utilizing SPF. U.S. Pat. No. 4,429,824 of Woodward discloses a method of combining SPF and DB to form a cylindrical shaped part from a pair of Titanium sheets which are first rolled into cylinders and concentrically juxtaposed. The tooling includes an internal mandrel made of a material having a relatively high coefficient of thermal expansion and an external mandrel made of a material having a relatively low coefficient of thermal expansion. These mandrels are referred to as "Delta-Alpha" tooling. Forming shims are positioned within the tooling to predesignate areas of diffusion bonding when the applied pressure and differential expansion of the tooling forces the sheets of material together at the shim locations.

Because of the limited amount of differential thermal expansion in the Delta-Alpha tooling, it is not suitable for forming large cylindrical structures by SPF when substantial deformations in the radial direction are required. It has been known, therefore, to roll a sheet of Titanium into a cylinder, and then to weld circular shaped sheets of Titanium to the upper and lower ends of the cylinder to form a gas tight container. Argon gas can then be introduced into the sealed container, after it has been heated to a temperature at which it exhibits superplasticity, in order to blow the cylindrical sheet radially outwardly against ceramic dies. The problem with this approach is that it is time consuming to weld the circular Titanium sheets to the upper and lower ends of the cylindrical Titanium sheet. When the formed part has cooled, it is necessary to cut off the ends of the part. The amount of scrap Titanium generated is substantial. This Titanium must be completely reprocessed before it can results in significant cost in fabricating such parts. be used again in the fabrication of aircraft parts. This My U.S. Pat. No. 4,984,732 discloses a method of superplastically forming and diffusion bonding a generally cylindrical laminate structure in order to provide for a minimum thicknesses at certain points of extreme deformation. In the method disclosed in my aforementioned U.S. Pat. No. 4,984,732, a sealing ring is positioned between the upper edge of an outer Titanium cylinder and the upper edge of a seal diaphragm. Another sealing ring adjacent a support holds the seal diaphragm tightly against the sealing ring. In this method, the cylinders must be positioned over an inner mandrel made, for example, of corrosion resistant stainless steel.

Despite the improvements disclosed in my aforementioned U.S. Pat. No. 4,984,732, the sealing of large diameter generally cylindrical structures at high temperatures, e.g. 1,700° F. or more, so that they can be pressurized for SPF/DB operations has been a major and costly problem.

It would be desirable to provide an improved SPF apparatus for fabricating large generally cylindrical structures without the need for the inner mandrel and complex seal arrangement disclosed in my aforementioned U.S. Pat. No. 4,984,732.

SUMMARY OF THE INVENTION

It is therefore the primary object of the present invention to provide an improved apparatus for superplastic forming of large generally cylindrical structures.

It is another object of the present invention to provide an improved gas impervious seal for the opposite ends of a cylindrical part blank in a press designed to superplastically form large generally cylindrical structures that require substantial deformations in the radial direction.

The illustrated embodiment of my invention includes a generally cylindrical ceramic die having a radially inwardly facing surface defining the contour of a structure to be formed from a cylindrically rolled metal sheet positioned radially inwardly therefrom. A generally cylindrical metal jacket surrounds the ceramic die for reinforcing the same against radially outwardly directed loading forces. A first radiant heater is positioned radially inwardly of the rolled metal sheet for heating a medial portion thereof to a predetermined temperature at which it achieves a superplastic condition. An upper horizontal generally cylindrical metal support member having a radially outwardly facing surface is provided for expanding and contacting an upper portion of the rolled metal sheet so that it contacts the radially inwardly facing surface of the ceramic die. An upper generally cylindrical metal seal member is provided adjacent the upper horizontal support member and also has a radially outwardly facing surface for expanding and contacting the upper portion of the rolled metal sheet so that it contacts the radially inwardly facing surface of the ceramic die. A lower horizontal generally cylindrical metal support member having a radially outwardly facing surface is provided for expanding and contacting a lower portion of the rolled metal sheet so that it contacts the radially inwardly facing surface of the ceramic die. A lower generally cylindrical metal seal member is provided adjacent the lower horizontal support member and also has a radially outwardly facing surface for expanding and contacting the lower portion of the rolled metal sheet so that it contacts the radially inwardly facing surface of the ceramic die. An upper seal ring is positioned between the upper horizontal support member, the upper seal member and an upper radially inwardly facing surface of the rolled metal sheet. A lower seal ring is positioned between the lower horizontal support member, the lower seal member and a lower radially inwardly facing surface of the rolled metal sheet. Additional radiant heaters are provided for heating the upper and lower seal rings so that they soften. Gas conduits are provided for introducing a pressurized gas to force the medial portion of the rolled metal sheet radially outwardly against the ceramic die when the seal rings are softened to provide substantially gas impervious seals and the medial portion of the rolled metal sheet has been heated to a superplastic condition.

Thus my invention provides an SPF press for forming large generally cylindrical structures from a sheet made of a first metal rolled into a cylindrical part blank. This first metal is preferably Titanium or Titanium alloy. The press has a generally cylindrical die with a surface defining the contour of a part to be formed by pressing a first side of the part blank thereagainst. A critical aspect of my invention is the provision of a generally cylindrical gas impervious seal that overlies at least one of a pair of ends of the cylindrical part blank on a second side thereof opposite the first side. This gas impervious seal includes a support member and a seal member. The support member and the seal member are spaced apart to define a gap therebetween. A generally cylindrical seal ring is seated in the gap and contacts the second side of the cylindrical part blank. The seal ring preferably has a round cross-section and is made of a second metal that is softened at a temperature at which the first metal becomes superplastic. Where the part blank is made of Titanium or Titanium alloy, the seal ring is preferably made of Copper. The seal ring deforms to provide a substantially gas impervious seal to prevent high pressure gas introduced against a medial portion of the cylindrical part blank from escaping to the one end of the part blank and thus reducing the available force for driving the medial portion of the part blank against the die.

DESCRIPTION OF THE PREFERRED EMBODIMENT

Figures 1, 2:
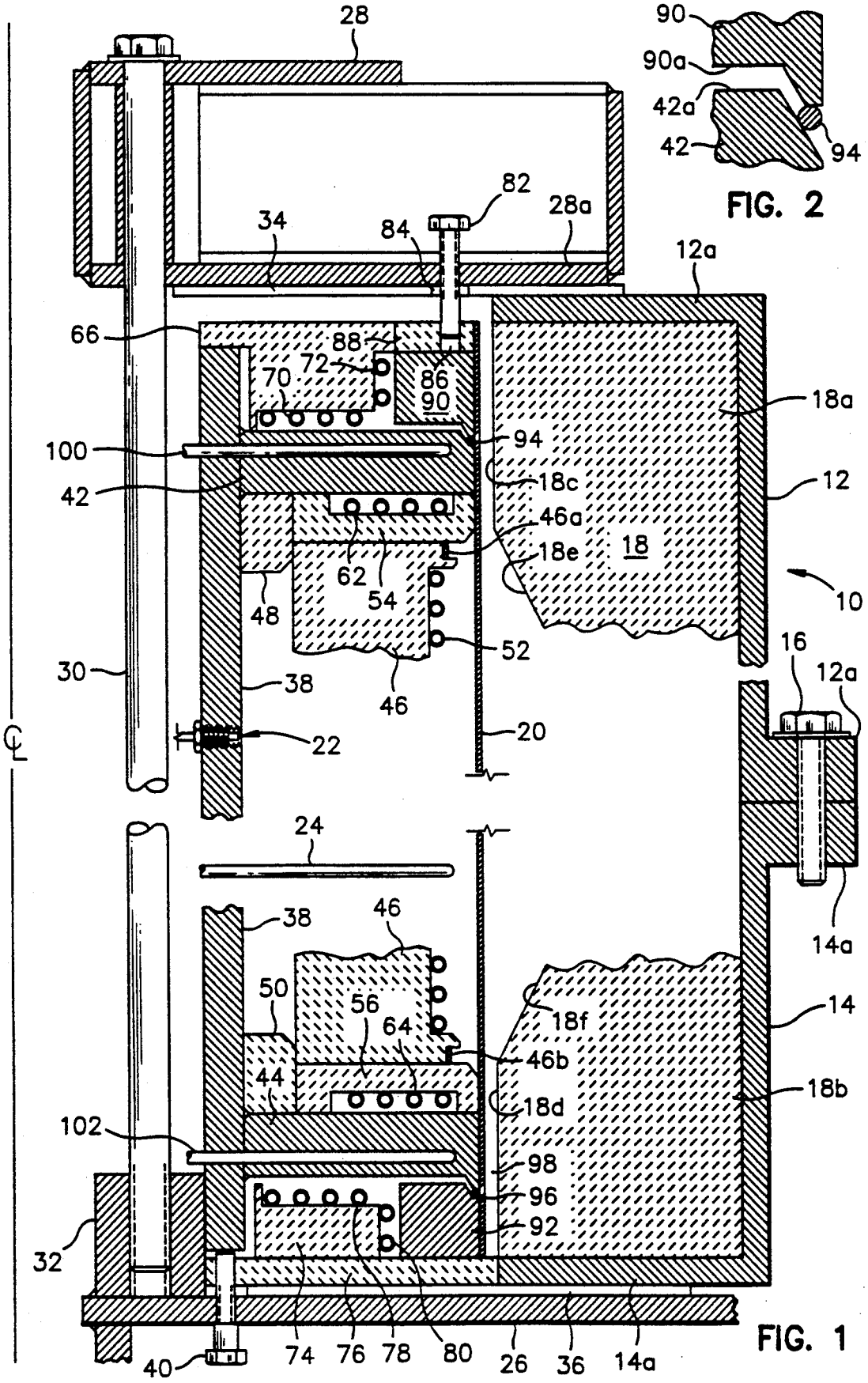
FIG. 1 is a fragmentary vertical sectional view of an SPF apparatus in accordance with my invention. The designation $C_L$ denotes the centerline of the apparatus which has an overall cylindrical configuration.
FIG. 2 is a greatly enlarged view illustrating details of the gas impervious seal utilized in the apparatus of FIG. 1.

FIG. 1 illustrates a portion of an SPF press in accordance with my invention. The press 10 has an overall cylindrical configuration. The design illustrated is that of a prototype which was built to test the concept of my invention.

The press 10 includes upper and lower cylindrical outer jackets 12 and 14 made of steel. These jackets have radial flanges 12*a* and 14*a* which abut one another and are held together by circumferentially spaced bolts such as 16 or other mechanical locking devices. A forming die 18 having a cylindrical configuration abuts against the inner walls of the cylindrical steel jackets 12 and 14. Preferably, the ceramic die is made of a hard ceramic material having great compressive strength. This material may consist of, for example, Calcium-Aluminate binder and fused Silica aggregate. Suitable ceramic material for this purpose is sold under the trademark THERMOSIL. Unless otherwise indicated, the ceramic components of my press which are described hereafter may be similarly made of the same hard ceramic material. The ceramic die 18 may be poured in place inside the steel jackets in the form of upper and lower sections 18*a* and 18*b*. These sections have radially inwardly facing vertical surfaces 18*c* and 18*d* as well as inclined, radially inwardly facing surfaces 18*e* and 18*f*. The surfaces 18*c*, 18*d*, 18*e* and 18*f* define the contour of the generally cylindrical structure to be formed, such as the exhaust mixer of a turbofan aircraft engine.

A large sheet of Titanium is rolled into a cylinder 20 and is loaded inside of the press with its axis in a vertical orientation. As explained hereafter in greater detail, once this cylindrical Titanium part blank 20 has been heated to a superplastic state, Argon gas is introduced through conduit 22 at a pressure of, for example, 100–300 PSI, for the purpose of the forcing the medial portion of the cylinder radially outwardly (to the right in FIG. 1) against the surfaces 18*c*, 18*b*, 18*e* and 18*f* of the surrounding ceramic die 18.

The upper and lower cylindrical steel jackets 12 and 14 are supported by a frame that includes a horizontal steel base plate 26. The frame further includes a hollow steel clamping cover 28. The base plate 26 and cover 28 are held together by long vertical bolts such as 30. Hydraulic or mechanical clamps can be used in lieu of bolts 30. The lower ends of these bolts are threaded into cylindrical receptacles such as 32 welded to the upper side of the base plate 26.

Multi-channel heat exchangers 34 and 36 are provided at the top and bottom of the press 10. These have a small amount of water continuously pumped therethrough in order to prevent excessive heat build-up in the steel pressure shell and frame. The heat exchangers may be formed of closely spaced horizontal stainless steel plates connected to each other by spaced apart, vertical steel dividers (not illustrated). The horizontal portion 14*a* of the lower cylindrical steel jacket 14 rests on top of the lower heat exchanger 36. The outer portion of the upper heat exchanger 34 rests on top of the horizontal portion 12*a* of the upper cylindrical steel jacket.

An inner vertical stainless steel cylindrical support 38 rests on top of the upper ends of positioning bolts such as 40. These bolts are screwed through threaded holes in the steel base plate 26. Upper and lower horizontal cylindrical stainless steel support members 42 and 44 are welded to the cylindrical support 38. These support members 42 and 44 extend radially outwardly from the vertical cylindrical support 38 toward the ceramic die 18.

A main ceramic heater support 46 having a vertical cylindrical configuration surrounds the steel cylindrical support 38. The main ceramic heater support 46 is spaced from the stainless steel cylindrical support 38 by upper and lower ceramic spacer rings 48 and 50. The outer vertical face of the main ceramic heater support 46 is formed with a recess. The support 46 is preferably made of a special lightweight foam ceramic material. Resistance type heating elements in the form of Nichrome wire coils 52 are attached to the ceramic support in the recess via fasteners, such as staples (not illustrated). Suitable coils of this type are sold under the trademark KANTHAL. The staples are pressed into the foam ceramic heater support 46 in order to secure the coils 52 thereto. The staples preferably have tapered edges which cause them to deflect outwardly upon insertion into the ceramic foam material. This outward spreading prevents the staples from working loose and allowing the radiant heating coils 52 to fall away from the ceramic support 46. The staples are preferably made of the same material as the coils 52.

One suitable foam ceramic material is commercially available from CERADYNE. Preferably the foam ceramic material has a maximum density of approximately thirty pounds per cubic foot with 80% porosity. It has a compressive strength of approximately 600 PSI. This type of foam ceramic material is supplied by the manufacturer in blocks which may be sawed to the desired size. By mounting the radiant heating coils 52 to the outer side of the ceramic heater support 46, the maximum amount of heat is radiated from the coil to the Titanium part blank 20. This greatly improves the heating efficiency that would otherwise be achieved by mounting the coils in slots formed in the heater support 46.

Foam ceramic heater support rings 54 and 56 abut the upper and lower ends of the main ceramic heater support 46 and are also spaced from the vertical steel cylindrical support 38 by the ceramic spacer rings 48 and 50. If necessary the ceramic heater support rings 54 and 56 may be separated from the horizontal steel support members 42 and 44 by ceramic spacer plates (not illustrated). These prevent the heaters from shorting out by contacting steel support members 42 and 44. The ceramic heater support rings 54 and 56 have recesses formed on the upper and lower sides thereof thereof, respectively. Radiant heating coils 62 and 64 are supported inside these recesses using staples (not illustrated) which are press fit into the ceramic heater support rings 54 and 56.

Another foam ceramic heater support ring 66 rests on top of the cylindrical steel support 38 and the horizontal steel support member 42. The ceramic heater support ring 66 has radiant heater coils 70 and 72 attached via staples along the underside and outer side thereof. Similarly, another foam ceramic heater support ring 74 is positioned below the lower steel support member 44 and is supported on top of a ceramic base ring 76. The ring 76 sits on top of the lower heat exchanger 36. The lower ceramic heater support ring 74 has radiant heating coils 78 and 80 attached via staples to the upper and outer surfaces thereof.

The ceramic base ring 76 has a plurality of holes through which extend the locater bolts 40. A plurality of upper locator bolts such as 82 extend through corresponding circumferentially spaced threaded holes in the horizontal base **28*a* of the hollow steel cover 28. These bolts extend through gaps such as 84 in the upper heat exchanger 34. The lower ends of the bolts 84 extend into holes such as 86 in a ceramic positioner ring 88. A first cylindrical steel seal member 90 is positioned slightly above the upper horizontal steel support member 42. A second cylindrical steel seal member 92 is positioned slightly below the lower horizontal steel support member 44. The seal member 90 is positioned radially outwardly of the ceramic heater support ring 66, and contacts the lower side of the ceramic positioner ring 88. The seal member 92 is positioned radially outwardly of the ceramic heater support ring 74**.

As best seen in FIG. 2, the steel support member 42 and the steel seal member 92 have opposing surfaces **42*a* and 90*a* which oppose one another and are slightly spaced apart. Moving in a radially outwardly direction, which is to the right in FIG. 2, the surfaces 42*a* and 90*a* are at first both horizontal, then they are downwardly inclined and extend in a parallel direction. The final segment of the surface 90*a* extends horizontally again to provide a shoulder against which is seated a seal ring 94 which has a round cross-section. Referring again to FIG. 1, the lower horizontal steel support member 44 and the adjacent lower steel seal member 92 have surfaces shaped similar to 42*a* and 90*a* for receiving another seal ring 96. Preferably, the seal rings 94 and 96 are made of Copper so that they will soften between approximately 1500°-1600° F. This softening is accomplished utilizing heat generated from the coils 62, 70, and 72 with respect to the upper seal ring 94 and from the coils 64, 78 and 80 with respect to the lower seal ring 96. The Titanium cylinder 20 overlies the seal rings 94 and 96. Each seal ring is seated in the gap between its corresponding horizontal support member and seal member. The seal rings are softened and deform to establish gas impervious seals to prevent the escape of pressurized Argon gas which is introduced through gas conduit 22. This gas forces the medial portion of the Titanium cylinder against the inwardly facing surfaces 18*c*, 18*d*, 18*e* and 18*f* of the ceramic die 18 to thereby form the part. The escape of this gas over the ends of the Titanium cylinder 20 would reduce the driving force available for forming the cylinder against the ceramic die 18. The seal rings preferably have a round cross-section, although they could have some other cross-section so long as they could deform sufficiently to provide the required sealing effect. By way of example, each of the seal rings 94 and 96** may be provided in the form of a suitable continuous length of No. 6 Copper wire and brazed into a ring.

The size of the gap 98 between the Titanium cylinder 20 and the ceramic die 18 is exaggerated in FIG. 1. When the part 20 reaches a nominal forming temperature between approximately 1600°-1700° F., the steel support members 42 and 44 as well as the seal members 90 and 92 will have expanded sufficiently so that the upper and lower ends of the Titanium cylinder 20 lightly contact the ceramic die 18. This contact is not illustrated in FIG. 1.

The radiant heating coil 52 is the primary source of heat which places the medial portion of the Titanium cylinder 20 in a superplastic condition. A thermocouple probe 24 extends horizontally through the main ceramic heater support block 46 for monitoring the temperature of the part blank 20. The signal from the thermocouple in this probe is used to adjust the currents in the radiant heating coil 52. Additional thermocouple probes (not illustrated) are used to monitor the temperature of the seals and to adjust the currents to the coils 62, 64, 72 and 78.

The bolts 40 support the massive weight of the main inner cylindrical steel support 38. They are adjusted to insure that the support 38 is in a true vertical position. This prevents copper seal 96 from being forced between the part blank 20 and the seal member 92 prematurely. The bolts 40 are backed off after the thermocouples indicate that the lower seal region has reached at least 1500 degrees F. At this time the thermal expansion of support 38 and seal member 92 will cause part blank 20 to nearly contact surface 18*d* of the main ceramic die 18. This insures that seal 96 will not be forced between part blank 20 and seal member 92.

While I have described a preferred embodiment of my apparatus for SPF of large cylindrical structures, it should be understood that modifications and adaptations thereof will occur to persons skilled in the art. For example, the various cylindrical support members, seal members, radiant heating means and other structures in my press could be made in one-hundred and twenty degree segments to facilitate assembly of the press. In other words, they could be segmented along three radii or radial lines that intersect the central axis of the press. This would facilitate the withdrawal of Titanium structures with inward and outward convolutions that would be impossible to withdraw if the press were simply split along the diameter as shown in the preferred embodiment illustrated in FIG. 1. Where the various ceramic supports are radially split, it is necessary to hold them together in some fashion and this may be accomplished using, for example, INCONEL bands 46*a* and 46*b*.

Multiple part blanks and shims may be simultaneously formed in the press to accomplish both SPF and DB in one operation, as is well known to those skilled in the art. Therefore, the protection afforded my invention should only be limited in accordance with the scope of the following claims.

I claim:

1. An apparatus for superplastic forming of large generally cylindrical structures, comprising:

a generally cylindrical ceramic die having a radially inwardly facing surface defining the contour of a structure to be formed from a cylindrically rolled metal sheet positioned radially inwardly therefrom;

generally cylindrical jacket means surrounding the ceramic die for reinforcing the same against radially outwardly directed loading forces;

first radiant heating means positioned radially inwardly of the rolled metal sheet for heating a medial portion thereof to a predetermined temperature at which it achieves a superplastic condition;

an upper horizontal generally cylindrical metal support member having a radially outwardly facing surface for expanding and contacting an upper portion of the rolled metal sheet so that said sheet contacts the radially inwardly facing surface of the ceramic die;

an upper generally cylindrical metal seal member adjacent the upper horizontal support member and having a radially outwardly facing surface for expanding and contacting the upper portion of the rolled metal sheet so that said sheet contacts the radially inwardly facing surface of the ceramic die;

a lower horizontal generally cylindrical metal support member having a radially outwardly facing surface for expanding and contacting a lower portion of the rolled metal sheet so that said sheet contacts the radially inwardly facing surface of the ceramic die;

a lower generally cylindrical metal seal member adjacent the lower horizontal support member and having a radially outwardly facing surface for expanding and contacting the lower portion of the rolled metal sheet so that said sheet contacts the radially inwardly facing surface of the ceramic die;

an upper seal ring positioned between the upper horizontal support member, the upper seal member and an upper radially inwardly facing surface of the rolled metal sheet;

a lower seal ring positioned between the lower horizontal support member, the lower seal member and a lower radially inwardly facing surface of the rolled metal sheet;

second radiant heating means for heating the upper and lower seal rings so that they soften; and means for introducing a pressurized gas to force the medial portion of the rolled metal sheet radially outwardly against the ceramic die when the seal rings are softened to provide substantially gas impervious seals and the medial portion of the rolled metal sheet has been heated to a superplastic condition.

2. An apparatus according to claim 1 and further comprising a vertically extending generally cylindrical metal support positioned radially inwardly of, and connecting, the upper and lower horizontal support members.

3. An apparatus according to claim 1 wherein the seal rings have a circular cross-section.

4. An apparatus according to claim 1 wherein the rolled metal sheet is made of Titanium and the seal rings are made of Copper.

5. An apparatus according to claim 1 wherein the upper horizontal support member and the upper seal member have a pair of inclined opposing surfaces, at least one of which terminates adjacent the rolled metal sheet with a shoulder for receiving the upper seal ring.

6. An apparatus according to claim 1 wherein the lower horizontal support member and the lower seal member have a pair of inclined opposing surfaces, at least one of which terminates adjacent the rolled metal sheet with a shoulder for receiving the lower seal ring.

7. An apparatus according to claim 5 wherein the opposing surfaces are generally parallel.

8. An apparatus according to claim 1 the second radiant heating means includes a first pair of ceramic heater support rings on opposite sides of the upper horizontal support member and a second pair of ceramic heater support rings on opposite sides of the lower horizontal support member.

9. An apparatus according to claim 1 wherein the die, support members, seal members and radiant heating means are segmented along radial lines intersecting a central axis of the apparatus.

10. An apparatus according to claim 1 and further comprising water filled heat exchanger means adjacent the jacket means for preventing excessive heat build-up.

11. An apparatus for superplastic forming of large generally cylindrical structures, comprising:

a generally cylindrical ceramic die having a radially inwardly facing surface defining the contour of a structure to be formed from a cylindrically rolled sheet positioned radially inwardly therefrom, the sheet being made of a metal selected from the group consisting of Titanium and Titanium alloy; generally cylindrical jacket means surrounding the ceramic die for reinforcing the same against radially outwardly directed loading forces;

first radiant heating means positioned radially inwardly of the rolled metal sheet for heating a medial portion thereof to a temperature of between approximately at least 1600°–1700° F. at which it achieves a superplastic condition;

an upper horizontal generally cylindrical metal support member having a radially outwardly facing surface for expanding and contacting an upper portion of the rolled metal sheet so that it contacts the radially inwardly facing surface of the ceramic die;

an upper generally cylindrical metal seal member adjacent the upper horizontal support member and having a radially outwardly facing surface for expanding and contacting the upper portion of the rolled metal sheet so that it contacts the radially inwardly facing surface of the ceramic die;

a lower horizontal generally cylindrical metal support member having a radially outwardly facing surface for expanding and contacting a lower portion of the rolled metal sheet so that it contacts the radially inwardly facing surface of the ceramic die;

a lower generally cylindrical metal seal member adjacent the lower horizontal support member and having a radially outwardly facing surface for expanding and contacting the lower portion of the rolled metal sheet so that it contacts the radially inwardly facing surface of the ceramic die;

a vertically extending generally cylindrical metal support positioned radially inwardly of, and connecting, the upper and lower horizontal support members;

a round cross-section upper seal ring made of Copper positioned between the upper horizontal support member, the upper seal member and an upper radially inwardly facing surface of the rolled metal sheet;

a round cross-section lower seal ring made of Copper positioned between the lower horizontal support member, the lower seal member and a lower radially inwardly facing surface of the rolled metal sheet;

the upper horizontal support member and the upper seal member having a pair of inclined opposing surfaces, at least one of which terminates adjacent the rolled metal sheet with a shoulder for receiving the upper seal ring;

the lower horizontal support member and the lower seal member having a pair of inclined opposing surfaces, at least one of which terminates adjacent the rolled metal sheet with a shoulder for receiving the lower seal ring;

second radiant heating means for heating the upper and lower seal rings so that they soften, including a first pair of ceramic heater support rings on opposite sides of the upper horizontal support member and a second pair of ceramic heater support rings on opposite sides of the lower horizontal support member;

the die, support members, seal members and radiant heating means being segmented along radial lines intersecting a central axis of the apparatus;

water filled heat exchanger means adjacent the jacket means for preventing excessive heat build-up; and means for introducing a pressurized gas to force the medial portion of the rolled metal sheet radially outwardly against the ceramic die when the seal rings are softened to provide substantially gas impervious seals and the medial portion of the rolled metal sheet has been heated to a superplastic condition.

12. In an SPF press for forming large generally cylindrical structures from a sheet made of a first metal, rolled into a generally cylindrical part blank, the press having a generally cylindrical die with a surface defining the contour of a part to be formed by pressing a first side of the part blank thereagainst, the improvement comprising:

generally cylindrical seal means overlying at least one of a pair of ends of the cylindrical part blank on a second side thereof opposite the first side including a support member and a seal member, the support member and the seal member being spaced apart to define a gap therebetween, and a generally cylindrical seal ring seated in the gap and contacting the second side of the cylindrical part blank, the seal ring being made of a second metal that is softened at a temperature at which the first metal becomes superplastic and the seal ring deforming to provide a substantially gas impervious seal to prevent high pressure gas introduced against a medial portion of the cylindrical part blank from escaping to the one end of the part blank.

13. The invention of claim 12 wherein the first metal is selected from the group consisting of Titanium and Titanium alloy and the second metal is Copper.

14. The invention of claim 12 wherein the support member and the seal member have inclined opposing surfaces, at least one of which terminates adjacent the part blank with a shoulder for receiving the seal ring.

15. The invention of claim 14 wherein the opposing surfaces are generally parallel.

16. The invention of claim 12 wherein the seal ring has a round cross-section.

* * * * *